US011684543B1

(12) United States Patent
Pham

(10) Patent No.: US 11,684,543 B1
(45) Date of Patent: Jun. 27, 2023

(54) IONIZED PEDICURE CHAIR SYSTEM

(71) Applicant: Ben Thai Pham, Lawrenceville, GA (US)

(72) Inventor: Ben Thai Pham, Lawrenceville, GA (US)

( * ) Notice: Subject to any disclaimer, the term of this patent is extended or adjusted under 35 U.S.C. 154(b) by 0 days.

(21) Appl. No.: 17/959,073

(22) Filed: Oct. 3, 2022

Related U.S. Application Data

(63) Continuation-in-part of application No. 17/680,919, filed on Feb. 25, 2022.

(51) Int. Cl.
*A61H 33/00* (2006.01)
*A61H 35/00* (2006.01)

(52) U.S. Cl.
CPC ..... *A61H 33/6089* (2013.01); *A61H 33/6005* (2013.01); *A61H 35/006* (2013.01); *A61H 2201/0149* (2013.01); *A61H 2203/0431* (2013.01); *A61H 2205/12* (2013.01)

(58) Field of Classification Search
CPC ..... A47K 3/022; A61H 2033/0012; A61H 2033/0016; A61H 2033/0037; A61H 2033/141; A61H 2035/004; A61H 33/02; A61H 33/60; A61H 33/006; A61N 1/44–445
See application file for complete search history.

(56) References Cited

U.S. PATENT DOCUMENTS 8,918,924 B2 * 12/2014 Ton ..... A61H 35/006 4/584
9,173,810 B2 * 11/2015 Tran ..... A61H 33/0087
9,289,353 B2 * 3/2016 Ta ..... A61H 33/6084
2008/0010741 A1 * 1/2008 Ton ..... B44F 9/04 4/622
2011/0004994 A1 * 1/2011 Le ..... A61H 35/006 4/541.1

FOREIGN PATENT DOCUMENTS

KR 101714298 * 3/2017 ..... A61H 35/006

* cited by examiner

*Primary Examiner* — David P Angwin
*Assistant Examiner* — Nicholas A Ros
(74) *Attorney, Agent, or Firm* — Christopher Pilling

(57) ABSTRACT

An ionized pedicure chair system provides a pedicure treatment experience to a user with treated water. The system includes a built-in ionizer device configured to adjust the pH level of the water used for the pedicure as desired in the 2.5 to 6.0 pH range. The system includes a base supported built in water lines, a reclinable chair, and a double bowl system. The double bowl system includes an inner bowl and an outer bowl provided a decorative feature and eliminates spills from the inner bowl.

5 Claims, 8 Drawing Sheets

IONIZED PEDICURE CHAIR SYSTEM

CROSS-REFERENCE TO RELATED APPLICATIONS

The present invention is a continuation-in-part application which claims priority to U.S. non-provisional application Ser. No. 17/680,919 filed Feb. 25, 2022, which is incorporated in its entirety at least by reference.

BACKGROUND OF THE INVENTION

1. Field of the Invention

The present invention relates to pedicures but more particularly to an ionized pedicure chair system.

2. Description of Related Art

A pedicure is a treatment for a person's feet. The treatment is traditionally used to remove dead skin, soften existing skin, and similar foot treatments. There are many benefits for topical treatment with ionized water. However, currently there are not ionizer devices suitable for integration with pedicure chairs. Consequently, a solution is needed.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In one aspect of the invention, an ionized pedicure chair system is provided, comprising a base; a chair; a pedicure base; an inner bowl having a first shape and first drain, wherein the inner bowl is positioned and fastened stationary on top of the pedicure base and lined to reduce contamination between users; an outer bowl having a second shape and second drain, wherein the outer bowl is positioned and fastened stationary on top of the pedicure base, and the outer bowl is taller than the inner bowl and surrounds the inner bowl such that the inner bowl is concealed from a horizontal view, and the second shape is different than the first shape; a hot water inlet coupled to a hot water source, and a cold water inlet coupled to a cold water source, the hot and cold water source to provide temperature controlled water having a pH level to the system; an ionizer device sized and shaped to be positioned within the pedicure base, the ionizer device coupled to the hot water inlet and the cold water inlet, wherein the inline ionizer device is configured to adjust the pH level of the temperature controlled water; a faucet coupled to the inline ionizer device and configured to direct the adjusted temperature water into the inner bowl; and, a main water drain, wherein the first drain and the second drain are in fluid communication with the main water drain.

In one embodiment, the inner bowl is round, oval, square, or any other desired shape. In one embodiment, the outer bowl is comprised of a decorative shape. In one embodiment, the ionizer device is configured to adjust the temperature controlled water to a pH level to 2.5 such that the water is configured to be used for first aid, to disinfect and heal cuts, scrapes, and burns. In one embodiment, the ionizer device is configured to adjust the water to a pH level between 4.5 and 6 such that the water is configured to be used as an astringent resetting a user's skin to its natural pH level. In one embodiment, a filter is positioned prior to the ionizer device, wherein the filter is configured to improve the performance of the ionizer device, and wherein the filter is accessible from a closable opening on the top of the pedicure base. In one embodiment, a pump is positioned after the ionizer device, wherein the pump ensures sufficient water pressure of the adjust pH temperature controlled water is delivered to the faucet.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

Figure 1:
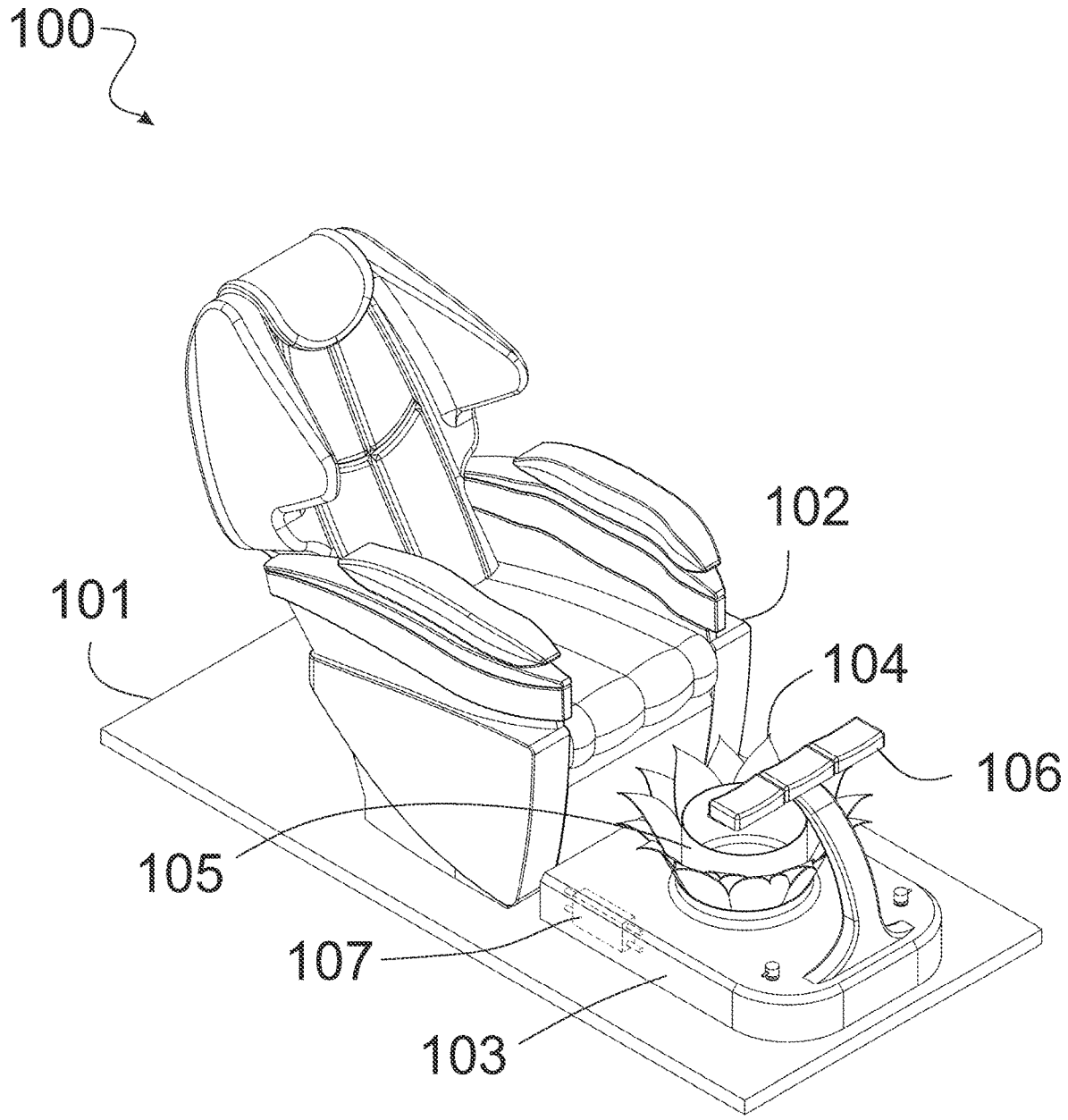
FIG. 1 is a front perspective view of an ionized pedicure chair system according to an embodiment of the present invention.
Figure 2:
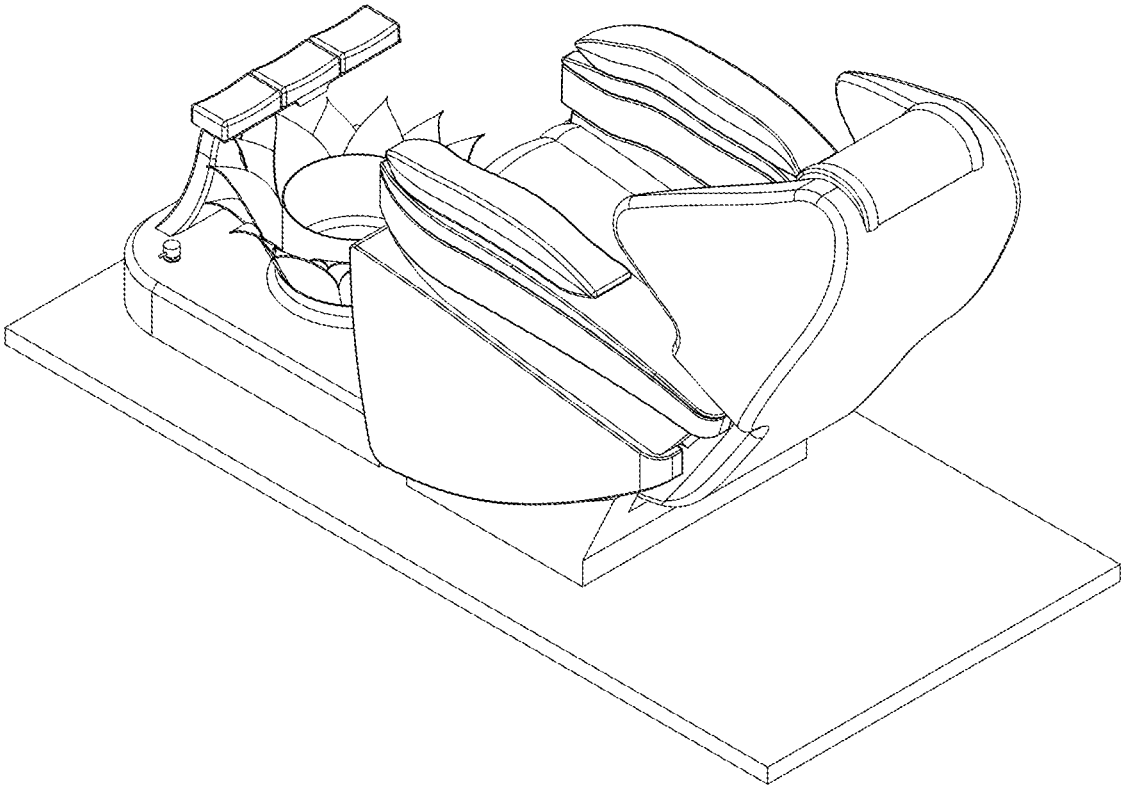
FIG. 2 is a rear perspective view of the ionized pedicure chair system according to an embodiment of the present invention.
Figure 3:
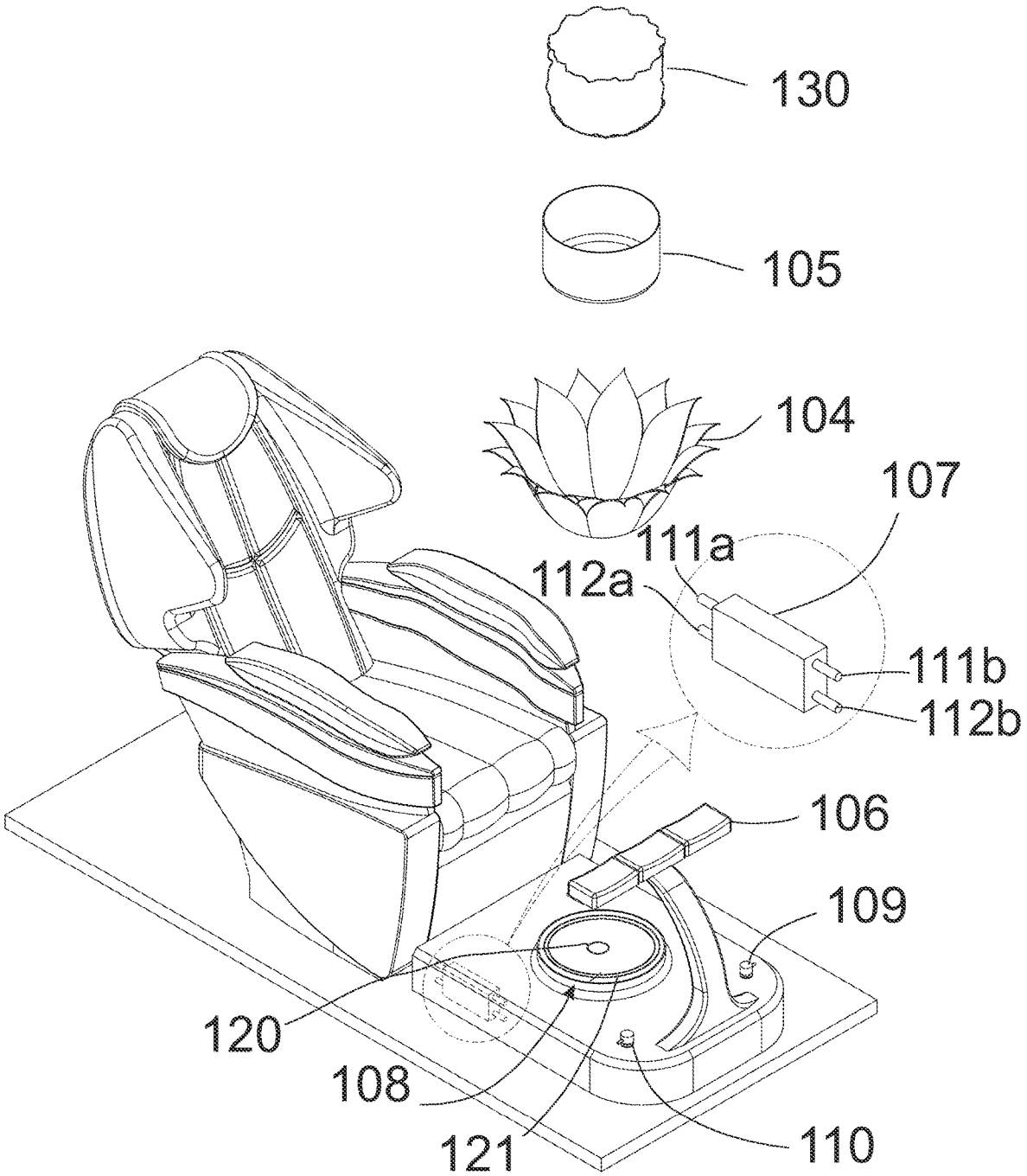
FIG. 3 is an exploded view of the ionized pedicure chair system with a detailed view of the inline ionizer device according to an embodiment of the present invention.
Figure 4:
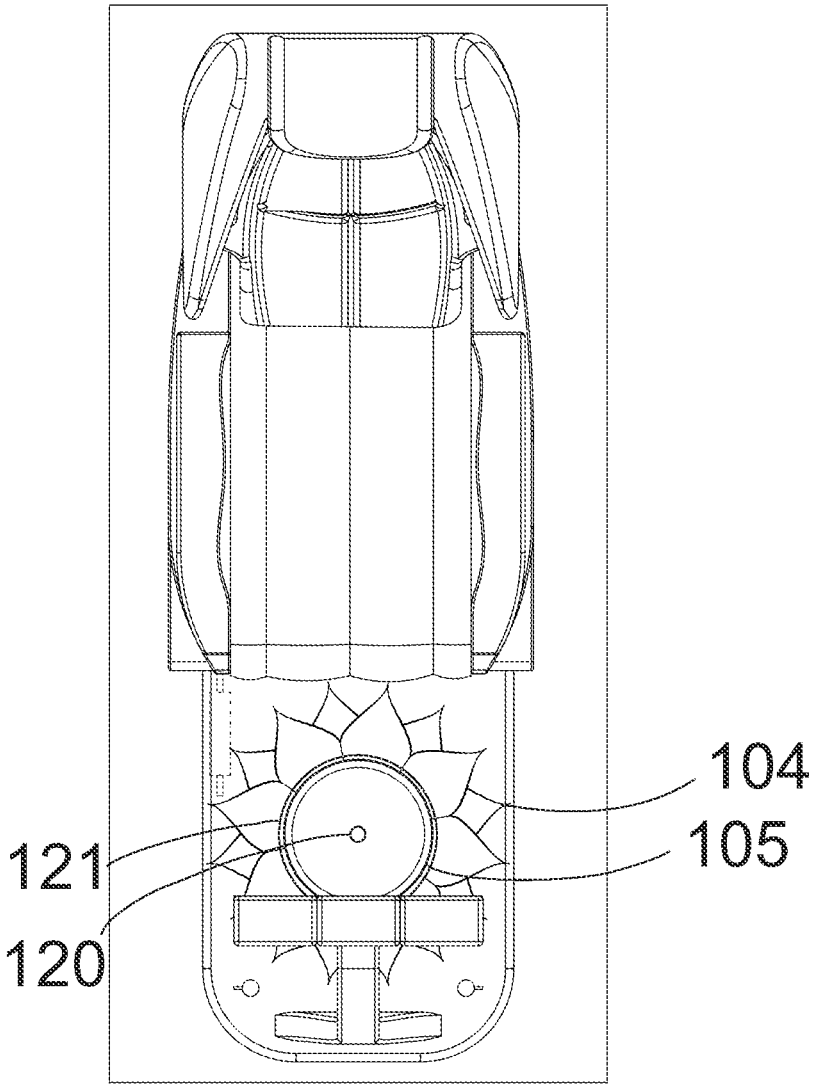
FIG. 4 is a top view of the ionized pedicure chair system according to an embodiment of the present invention.
Figure 5:
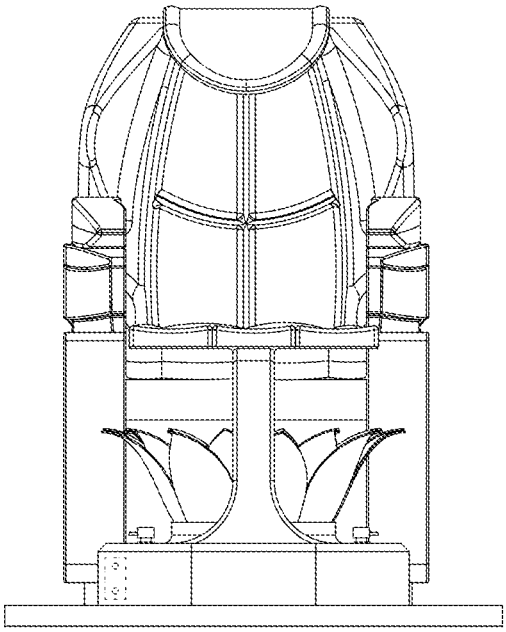
FIG. 5 is a front view of the ionized pedicure chair system according to an embodiment of the present invention.
Figure 6:
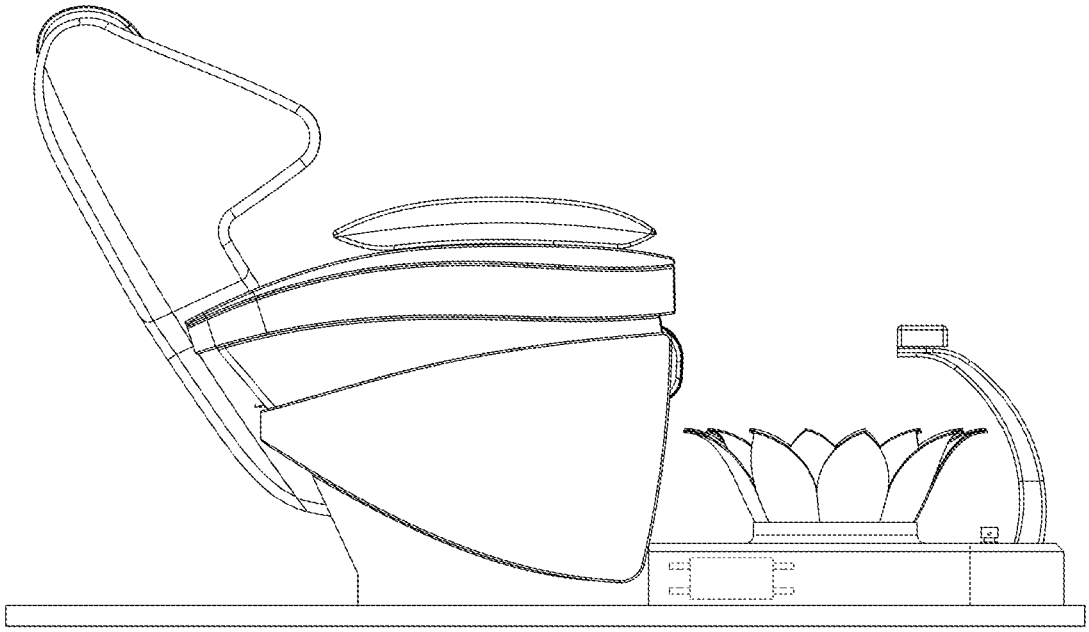
FIG. 6 is a right side view of the ionized pedicure chair system according to an embodiment of the present invention.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide an ionized pedicure chair system.

It is to be understood that the terminology used herein is for the purpose of describing particular embodiments only and is not intended to be limiting. The terms "a" or "an," as used herein, are defined as to mean "at least one". The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, not necessarily mechanically, and not permanent. The term "providing" is defined herein in its broadest sense, e.g., bringing/coming into physical existence, making available, and/or supplying to someone or something, in whole or in multiple parts at once or over a period of time. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Referring now to any of the accompanying FIGS. 1-8, the ionized pedicure chair system 100 is illustrated. In one embodiment, the ionized pedicure chair system 100 comprises a base 101, chair 102, pedicure base 103, an outer bowl 104, an inner bowl 105, a faucet 106, and an inline ionizer device 107. The base 101 is configured to hold the chair and pedicure base as well as hide structural and water lines, which will be discussed in greater details below. In one embodiment, the base is rectangular. The chair 102 may be any type of chair known in the art, preferable a reclinable chair that is comfortable for the user.

Figure 7:
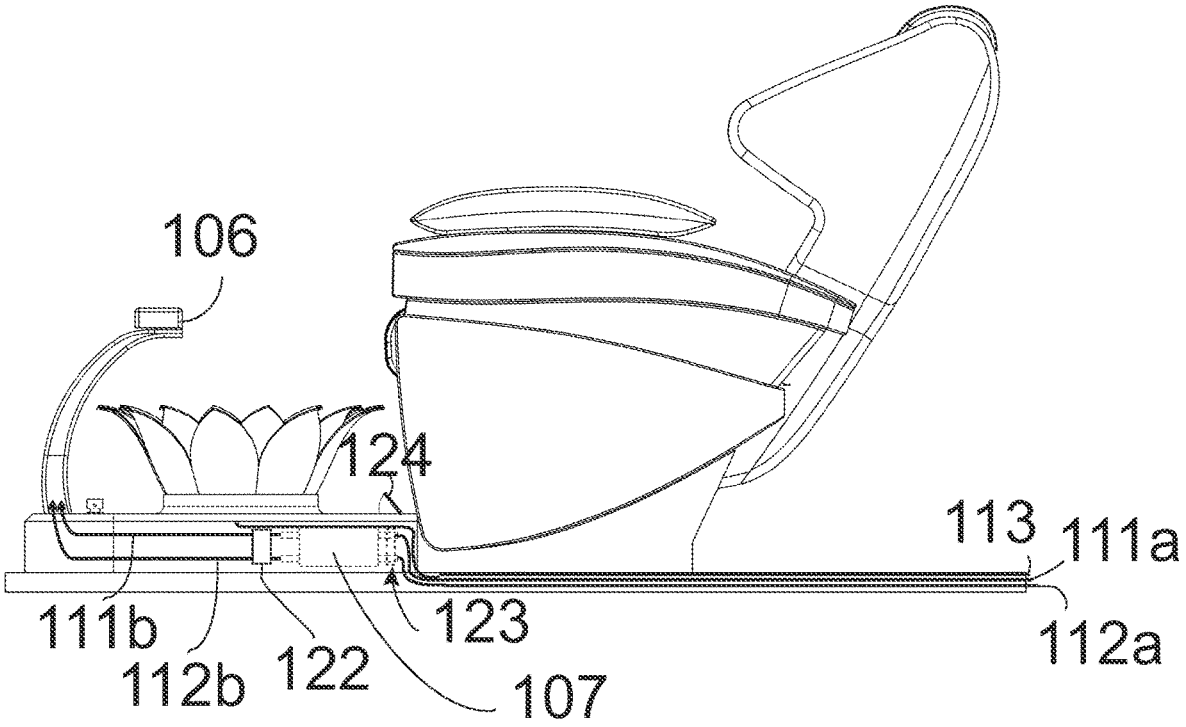
FIG. 7 is a left side view of the ionized pedicure chair system showing an exemplary instance of the internal water lines according to an embodiment of the present invention.
Figure 8:
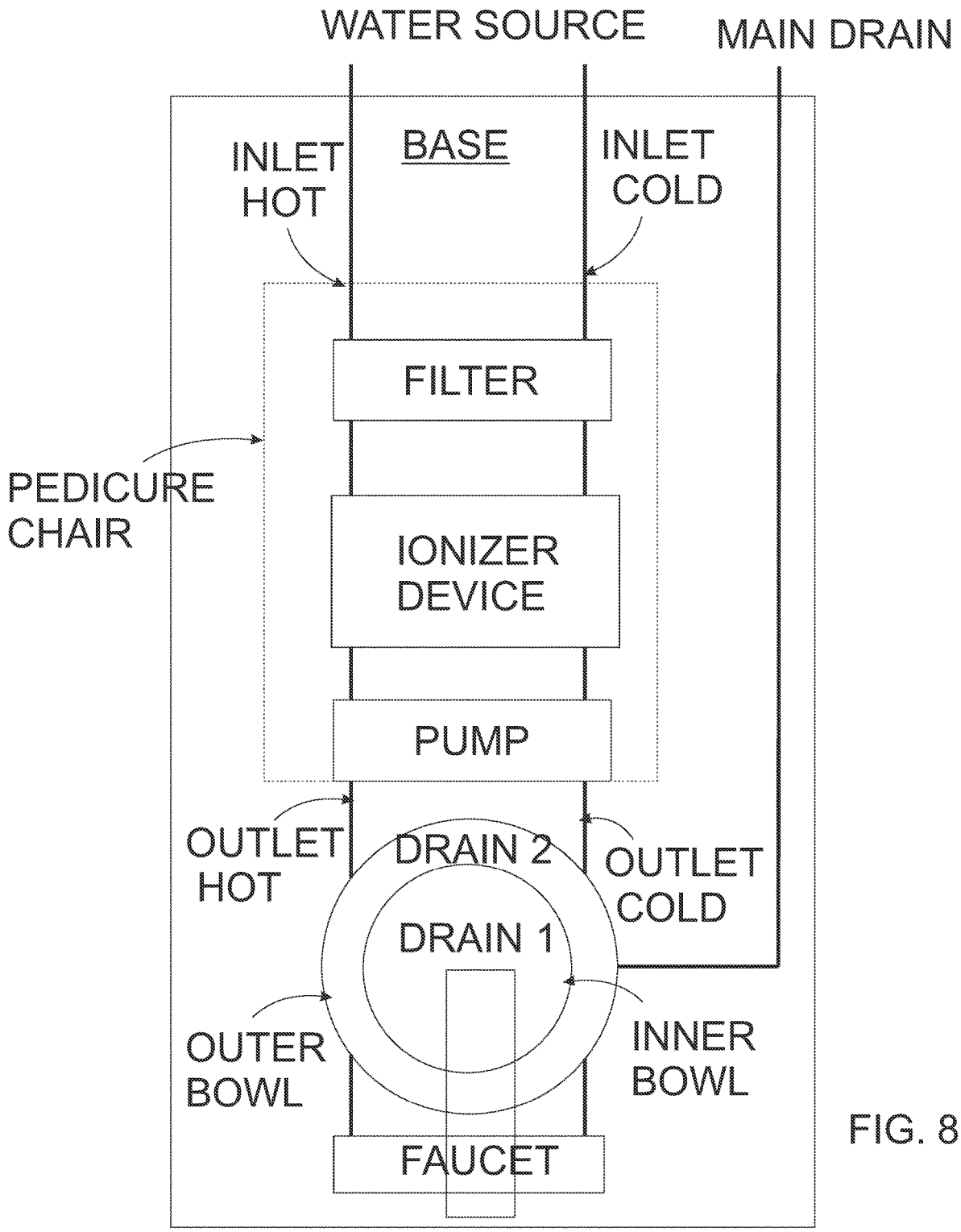
FIG. 8 is a plumbing schematic of the system according to an embodiment of the present invention.

In one embodiment, the pedicure base 103 houses internal components for the system, including but not limited to internal water lines for cold and hot water (111/112), a drainage line 113, and the inline ionizer device 107 which will be discussed in greater detail below. In some embodiments, the internal water lines connect to internal water lines within the base 101. The pedicure base 103 also supports and holds the inner and outer bowls 105 and 104 respectively on platform 108, as well as the faucet 106 and faucet handle 109 configured to control the water input as well known in the art. As previously mentioned, in some embodiments, base 101 is configured to hold the internal water lines as well as the drainage line (as illustrated in FIG. 7). Each bowl is permanently secured to the platform 108 via fasteners, adhesive, or similar.

In one embodiment, the inner bowl 105 is configured to hold water, normally warm water for the pedicure treatment, wherein the outer bowl 104 surrounds the inner bowl 105 and acts as an overflow bowl as well as a collection bowl if water is splashed out of the inner bowl during use. The outer bowl protects the inner bowl from damage and helps the inner bowl maintain warmer water temperatures for longer periods of time, e.g. via thermal insulation. Further, the outer bowl also acts as a decorative piece and can be any shape known in the art. A lotus flower is illustrated, but other flowers, shapes, designs may be provided. Each bowl has a drain which is configured to connect to the main drain line for the system, wherein the inner bowl 105 has drain 120 and the outer bowl 104 has drain 121. Advantageously, the outer bowl is higher than the inner bowl such that the inner bowl is hidden from sight when approaching the system, best seen in the side views FIG. 6 and FIG. 7. This is particularly useful as it is standard practice to line the pedicure bowls with a liner 130 to reduce contamination between users, thus the unsightly lined inner bowl is hidden. Further, the double bowl system avoids water messes particularly when warm water is added to the inner bowl during use. Also, water can be added to the inner bowl at any time during use without the requirement to drain the inner bowl first, as normally would be required. The faucet 106 is configured to direct the incoming water into the inner bowl. Its shape and design may be any shape and/or design as well known in the art.

It is a particular advantage of the present invention to provide an inline ionizer device 107 within the pedicure base 107. Best seen in FIG. 3, the inline ionizer device 107 includes inline water input 111*a*/112*a* and water 112*a*/112*b* output lines for both warm and cold water. During use, the inline ionizer device 107 is configured to treat the incoming water and adjust the pH level of the water such that treated water is deposited in the inner bowl 105 during use, wherein the treated water has a desired pH level. In some embodiments, the inline ionizer device 107 is configured to produce beauty water having a pH between 4.5 and 6. Advantageously, ionized acidic water acts as an astringent, naturally toning and tightening the skin, effectively resetting the skin's natural pH. In yet other embodiments, the inline ionizer device 107 is configured to produce acidic water having a pH around 2.5 which is configured to be used for first aid, to disinfect and heal cuts, scrapes, and burns. In one embodiment, there is a control knob 110, panel, or system that is configured to adjust the pH the inline ionizer device 107 produces. It should be noted that the pH level the ionizer device produces is only for topical skin treatment and is not for drinking or consumption. Water below pH of 6.5, as described in this application is unsafe for drinking.

In some embodiments, and additional solution is needed to reach a pH level of 2.5, for example electrolysis enhancer solution is added to the ionizer device to significantly lower the pH to the desired level. This and other adjustments to the pH affect the flow rate of the output water 111*b* and 112*b*. Consequently, a pump 122 is along the output lines 111*b* and 112*b* to effectively delivery the pH to the faucet 106. As traditional ionizer devices are for drinking water, the flow rate is not as of a concern, however it is time consuming to fill the inner bowl with the treated pH water which reduces the chair system's potential turnover. Thus, a strong water pressure and flow rate is needed. In some embodiments, a filter 123 is used along the inlet lines 111*a* and 112*a* prior to the water reaching the ionizer device 107, the filter ensuring good performance from the ionizer device. In some embodiments, a door 124, opening, lid, etc. is provided on the top surface of the base to access and replace the filter. Also, the size of the ionizer device is critical as it needs to securely fit within the base.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. An ionized pedicure chair system comprising:

a base;

a chair;

a pedicure base;

an inner bowl having a first shape and first drain, wherein the inner bowl is positioned and fastened stationary on top of the pedicure base and lined to reduce contamination between users;

an outer bowl having a second shape and second drain, wherein the outer bowl is positioned and fastened stationary on top of the pedicure base, and the outer bowl is taller than the inner bowl and surrounds the inner bowl such that the inner bowl is concealed from a horizontal view, and the second shape is different than the first shape;

a hot water inlet coupled to a hot water source, and a cold water inlet coupled to a cold water source, the hot and cold water source to provide temperature controlled water having a pH level to the system;

an inline ionizer device sized and shaped to be positioned within the pedicure base, the ionizer device coupled to the hot water inlet and the cold water inlet, wherein the inline ionizer device is configured to adjust the pH level of the temperature controlled water;

a filter positioned prior to the inline ionizer device, wherein the filter is configured to improve the performance of the inline ionizer device, and wherein the filter is accessible from a closable opening on the top of the pedicure base;

a faucet coupled to the inline ionizer device and configured to direct the adjusted temperature water into the inner bowl;

a main water drain, wherein the first drain and the second drain are in fluid communication with the main water drain; and, wherein an electrolysis enhancer solution is added to the inline ionizer device such that the inline ionizer device is configured to adjust the temperature controlled water to a pH level to 2.5 such that the water is configured to be used for first aid, to disinfect and heal cuts, scrapes, and burns.

2. The ionized pedicure chair system of claim 1, wherein the inner bowl is round.

3. The ionized pedicure chair system of claim 1, wherein the outer bowl is comprised of a decorative shape.

4. The ionized pedicure chair system of claim 1, further comprising a pump positioned after the inline ionizer device, wherein the pump ensures sufficient water pressure of the adjust pH temperature controlled water is delivered to the faucet.

5. A method comprising steps:

(a) providing a pedicure chair having a chair, a base, a faucet, an inner round bowl having a first drain, a round outer bowl having a second drain, wherein the round inner bowl and the round outer bowl are positioned and fastened stationary on top of a pedicure base and the round outer bowl is taller than the inner bowl and surrounds the inner bowl such that the inner bowl is concealed from a horizontal view, an inline ionizer device positioned within the pedicure base, and a water inlet;

(b) coupling the water inlet to a water source, wherein the water source provides tap water having a pH level of 6-8.5;

(c) coupling the first drain and the second drain to an external main drain;

(d) lining the round inner bowl with a liner to reduce contamination between users;

(e) adding an electrolysis enhancer solution to the inline ionizer device;

(e) adjusting, via the inline ionizer device, the provided tap water to have a pH level of 2.5; and, (f) filling up the lined inner bowl with the adjusted tap water for use, wherein the adjusted tap water having a pH level of 2.5 is used for first aid, to disinfect and heal cuts, scrapes, and burns of the users.

* * * * *